US007121845B2

(12) United States Patent
Liao et al.

(10) Patent No.: US 7,121,845 B2
(45) Date of Patent: Oct. 17, 2006

(54) IC SOCKET WITH IMPROVED HOUSING

(75) Inventors: Fang-Jwu Liao, Tu-cheng (TW); Hao-Yun Ma, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/174,693

(22) Filed: Jul. 5, 2005

(65) Prior Publication Data

US 2006/0040524 A1 Feb. 23, 2006

(30) Foreign Application Priority Data

Aug. 20, 2004 (TW) ..... 93213314 U

(51) Int. Cl.
*H01R 12/00* (2006.01)
*H01R 13/40* (2006.01)

(52) U.S. Cl. ..... 439/73; 439/331; 439/607; 439/733.1

(58) Field of Classification Search ..... 439/73, 439/733.1, 330, 331, 607
See application file for complete search history.

(56) References Cited

U.S. PATENT DOCUMENTS 3,951,495 A 4/1976 Donaher et al.
4,616,895 A 10/1986 Yoshizaki et al.
6,196,852 B1 3/2001 Neumann et al.
6,447,318 B1 9/2002 Okamoto
6,585,527 B1 7/2003 Koopman et al.
6,604,950 B1 8/2003 Maldonado et al.
6,695,625 B1 * 2/2004 Ma et al. ..... 439/70
6,705,876 B1 3/2004 Eldridge
6,805,561 B1 10/2004 Walkup et al.
6,824,395 B1 11/2004 Uratsuji
6,921,271 B1 * 7/2005 Liao et al. ..... 439/66
6,932,622 B1 * 8/2005 Liao et al. ..... 439/73
2004/0203264 A1 10/2004 Liao et al.
2005/0014398 A1 * 1/2005 Liao et al. ..... 439/71
2005/0054218 A1 * 3/2005 Liao et al. ..... 439/66
2006/0040524 A1 * 2/2006 Liao et al. ..... 439/73

* cited by examiner

*Primary Examiner*—James R. Harvey
(74) *Attorney, Agent, or Firm*—Wei Te Chung

(57) ABSTRACT

An IC socket (1) includes an insulative housing (2) and large numbers of contacts (9) received therein. The housing defines arrayed contact receiving cavities (22) for accommodating the contacts. The cavities are arranged in array by first partition walls (24) and second partition walls (25), which are perpendicular to each other. The first partition wall is higher than the second partition wall. Each first partition wall is provided with protruding portions (240) and sunken portions (241), which are alternatively arranged.

10 Claims, 8 Drawing Sheets

IC SOCKET WITH IMPROVED HOUSING

BACKGROUND OF THE INVENTION

1. Field of the Invention

The invention relates to an IC (integrated circuit) socket, on which an LGA (land grid array) package is mounted.

2. Description of the Related Arts

Modern computer systems increase in performance and complexity at a very rapid pace, driven by intense competition and market demands. In order to meet ever-increasing performance requirements, the area and volumetric interconnect densities of electronic board assemblies must increase accordingly. In combination with other competitive forces, this demand has driven the need for improved high-density socket technologies in computer applications, and the connector industry has responded with a variety of new alternatives to meet these needs. One of the most attractive of the new connector types is the land grid array (LGA) socket connector, which permits direct electrical connection between an LGA integrated circuit and a printed circuit board. LGA socket connectors are an evolving technology in which an interconnection between mating surfaces of an IC or other area array device and a printed circuit board is provided through a conductive terminal received in the socket connector. Connection is achieved by mechanically compressing the IC onto the socket connector.

A conventional IC socket for an LGA IC package with conductive pads generally comprises an insulative housing, and a plurality of contacts accommodating in the housing. For contacting with pads of the LGA IC package, the contact is provided with a spring arm extending out of the housing. However, the spring arm is easily to be damaged by inadvertently force, because there's no protective structure to protect the spring arms. In order to solve this problem, an improved IC socket appears. The improved IC socket is provided with a plurality partition walls surrounding the spring arms for protect the arms, which can solve the problem mentioned above. However, a new problem is produced. As known, the contact is inserted into the housing with carrier strip linking therewith. After the contact is positioned, the carrier strip must be removed away. Due to the partition walls, the strip frequently interferes with the partition wall, which seriously affect the operation efficiency.

In view of the above, what is needed is an IC socket which can effectively protect the contacts received therein, and can improve operation efficiency simultaneity.

SUMMARY OF THE INVENTION

According to the present invention, an improved IC socket is provided to resolve the disadvantages described above. The IC socket comprises a insulative housing and a plurality of contact received therein. The housing defines a plurality of arrayed contact receiving cavities for accommodating the contacts. The cavities are arranged in array by a plurality of first partition walls and a plurality of second partition walls, which are perpendicular to each other. The first partition wall is higher than the second partition wall. Each first partition wall is provided with protruding portions and sunken portions, which are alternatively arranged.

Due to the partition walls, the contacts can be protected even if inadvertently force is applied to the socket, and due to the sunken portions, the strip can be removed away without interfere with the partition walls.

Other advantages and novel features of the present invention will become more apparent from the following detailed description when taken in conjunction with the accompanying drawings, in which:

DESCRIPTION OF PREFERRED EMBODIMENT

Hereinafter, a preferred embodiment of the invention will be described in detail with reference to the attached drawings.

Figure 1:
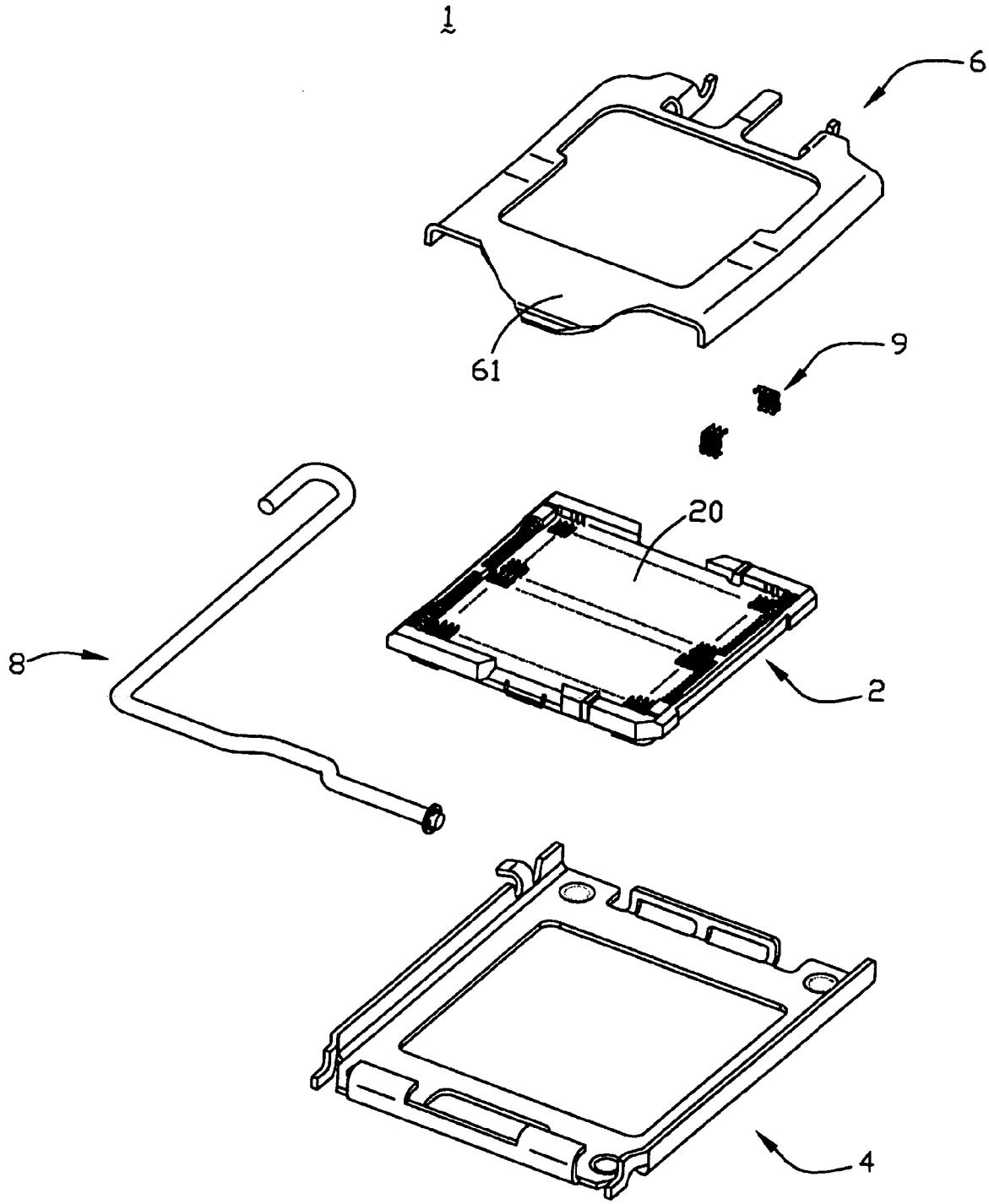
FIG. 1 is an exploded isometric view of an IC socket in accordance with a preferred embodiment of the present invention.
Figure 2:
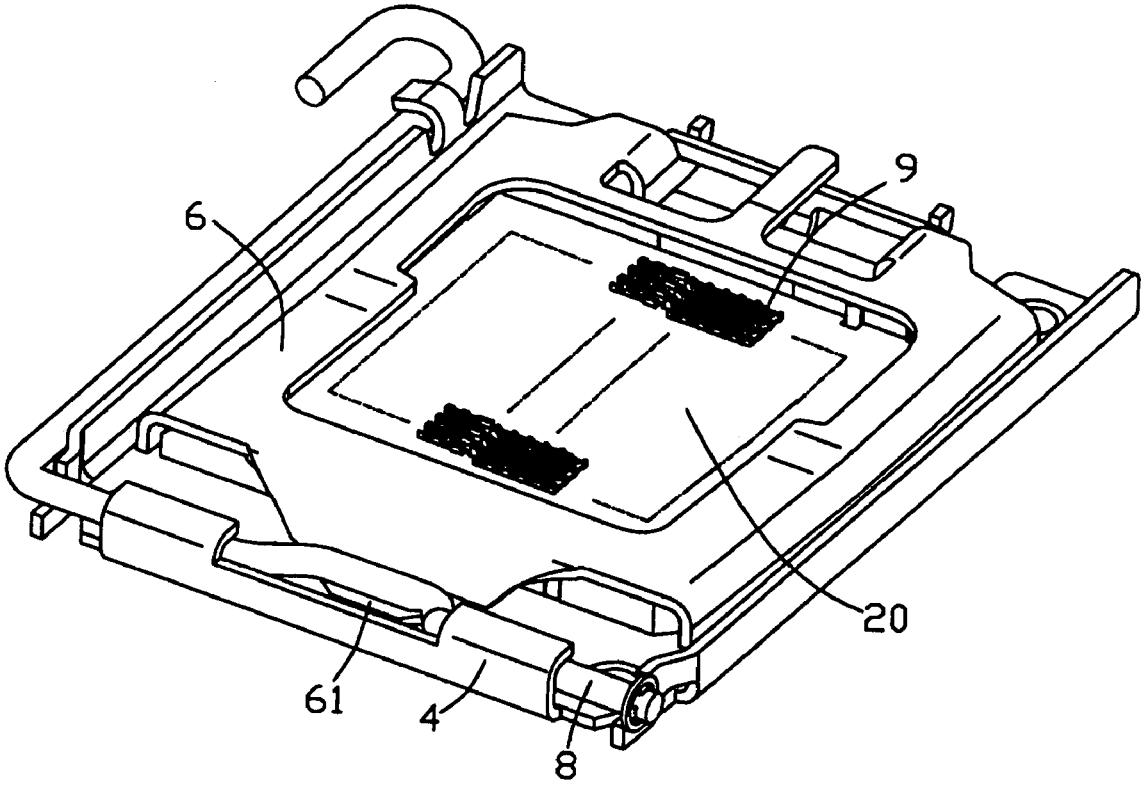
FIG. 2 is an assembled view of FIG. 1.

Referring first to FIGS. 1–2, the IC socket 1 comprises an insulative housing 2, a metallic reinforcing plate 4 surrounding the housing 2, a metallic cover member 6 pivotally assembled to one end of the reinforcing plate 4, and a actuating lever 8 pivotally assembled to the other end of the reinforcing plate 4. The housing 2 is mountable on a circuit board (not shown).

An IC package receiving recess 20 is formed in the housing 2. A plurality of contacts 9 are located in the IC package receiving recess 20. An IC package (not shown) is secured in the housing 2 by first pressing the cover member 6 downward so that the IC package is urged against the contacts 9, then engaging the actuating lever 8 with an engaging piece 61 at the foot of the cover member 6. The reinforcing plate 4, the cover member 6, and the actuating lever 8 will collectively be referred to as a fixing mechanism.

Figure 3:
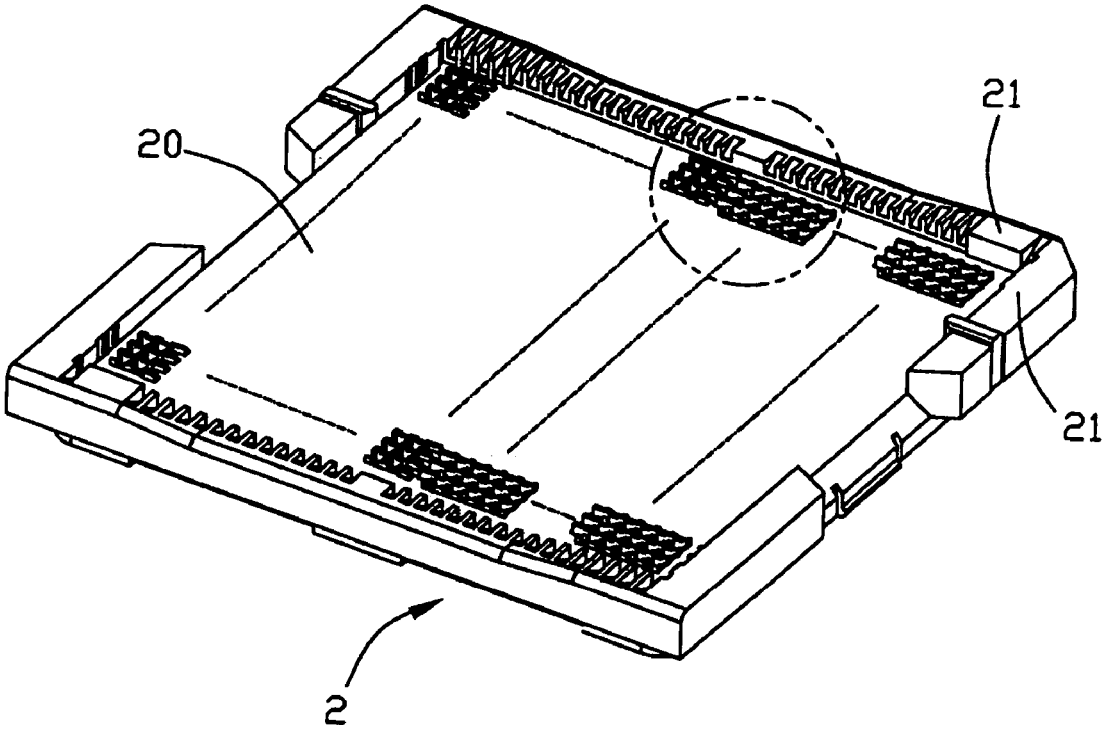
FIG. 3 is an isometric view of an insulative housing of the IC socket.
Figure 5:
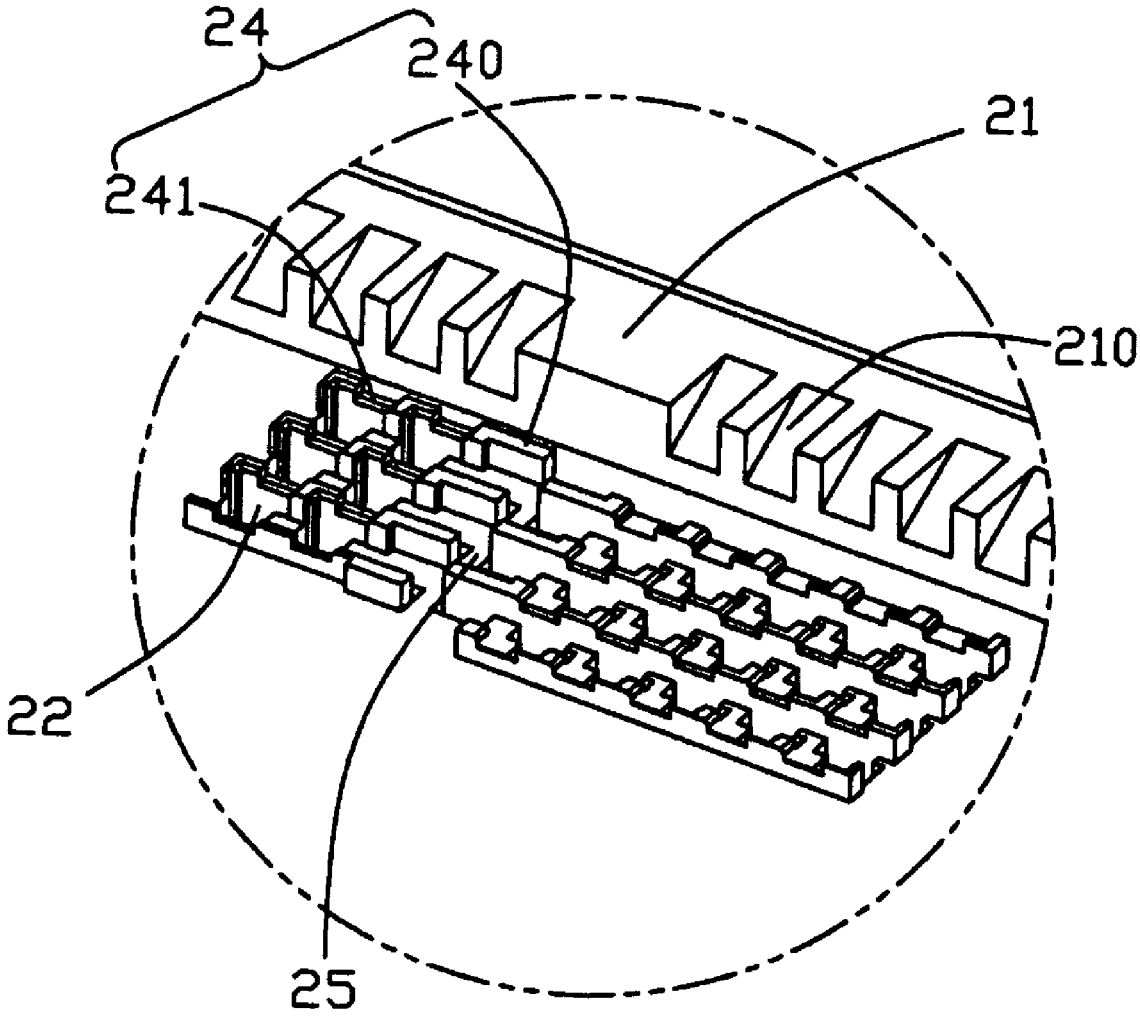
FIG. 5 is an enlarged view of the circled part V in FIG. 3.
Figure 6:
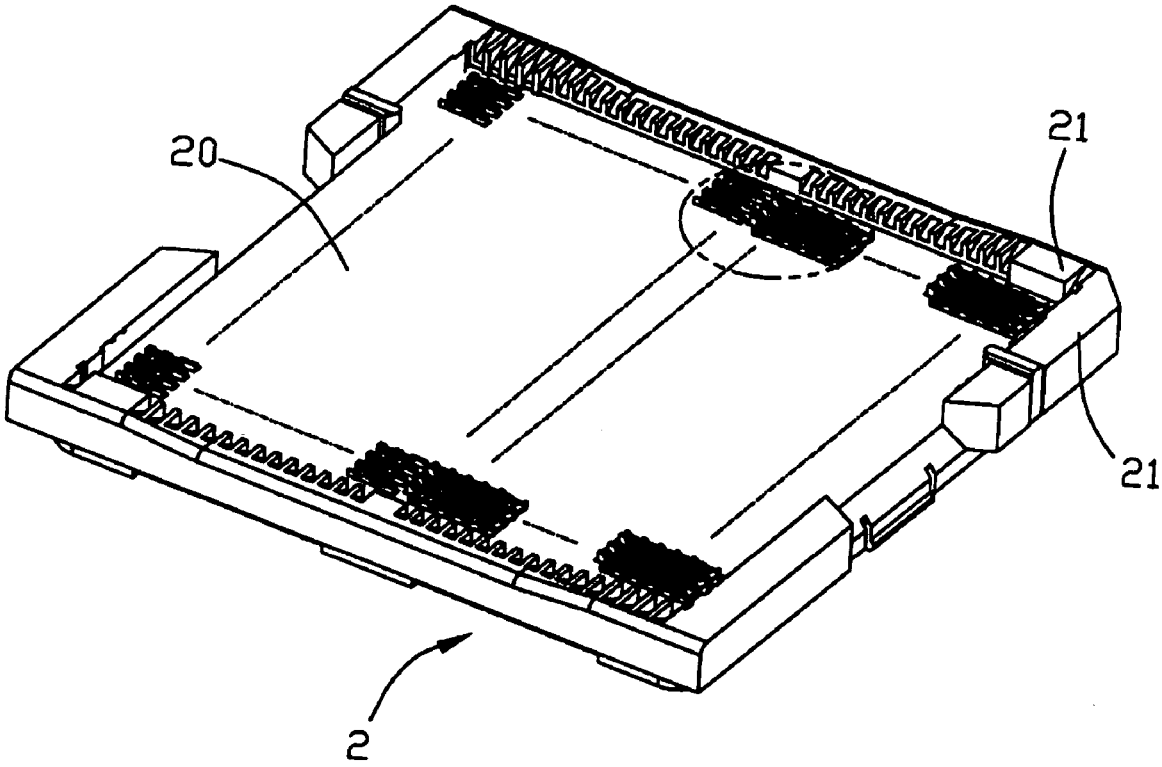
FIG. 6 is similar to FIG. 3, but illustrates the contacts received in the housing.

Referring to FIG. 3 and FIGS. 5–6, the insulative housing 2 is generally rectangular and is molded from an insulative material. The IC package receiving recess 20 is also rectangular as defined by outer peripheral walls 21. Contact receiving cavities 22 are formed and arranged in a matrix. Each contact 9 is housed in a corresponding contact receiving cavity 22. A pair of opposed peripheral walls are formed with a plurality of channels 210. The contact receiving cavities 22 are defined in a matrix arrangement by first partition walls 24 and second partition walls 25, which are perpendicular to each other. Specially, the first partition wall 24 is higher than the second partition wall 25.

As illustrated in FIG. 5, the first partition wall 24 comprises protruding parts 240 and sunken parts 241, which are alternately arranged. Top surface of the protruding parts 240 forms a seating plane for carrying the IC package. It's noted that each of the channels 210 is aligned with not only a line of contact receiving cavities 22, but also a line of sunken portions 241.

Figure 4:
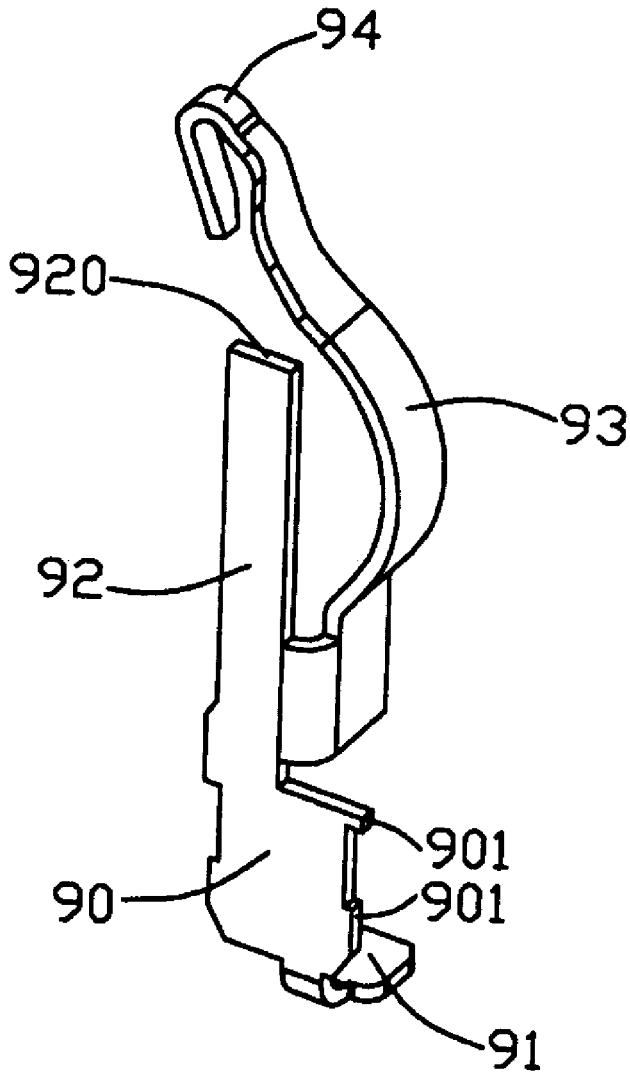
FIG. 4 is an isometric view of an electrical contact of the IC socket.

Referring back to FIG. 4, which is a isometric view of one contact 9 used in the IC socket 1. The contact 9 is formed from conductive material strip 95 (shown in FIG. 6) by stamping. Each contact 9 comprises a base portion 90 secured in the contact receiving cavity 22, a soldering pad 91 perpendicularly extending from a lower end of the base portion 90, a linking portion 92 connecting the strip 95, and a spring arm 93 extending from a lateral edge of the linking portion 92. A contacting tip 94 is formed at a distal end of the spring arm 93. The base portion 90 is provided with a plurality of barbs 901 for interferentially securing the contact 9 in the cavity 22.

When the IC package is mounted on the IC socket 1, the spring arms 93 flex downward against lands (not shown) of the IC package. The contacting tips 94 flex below the protruding portion 240 of the first partition wall 24. Finally, the IC package is supported by the seating plane formed by the protruding portions 240.

During mounting or dismounting of the IC package, a finger (not shown) may inadvertently touch or press the spring arms 93. However, downward movement of the finger is restricted by the first partition walls 24 thus preventing excessive force on the spring arms 93. The spring arms 93 remain within their ranges of elastic deformation as the finger contacts the first partition walls 24. Therefore, plastic deformation of the spring arms 44 is prevented.

Figure 7:
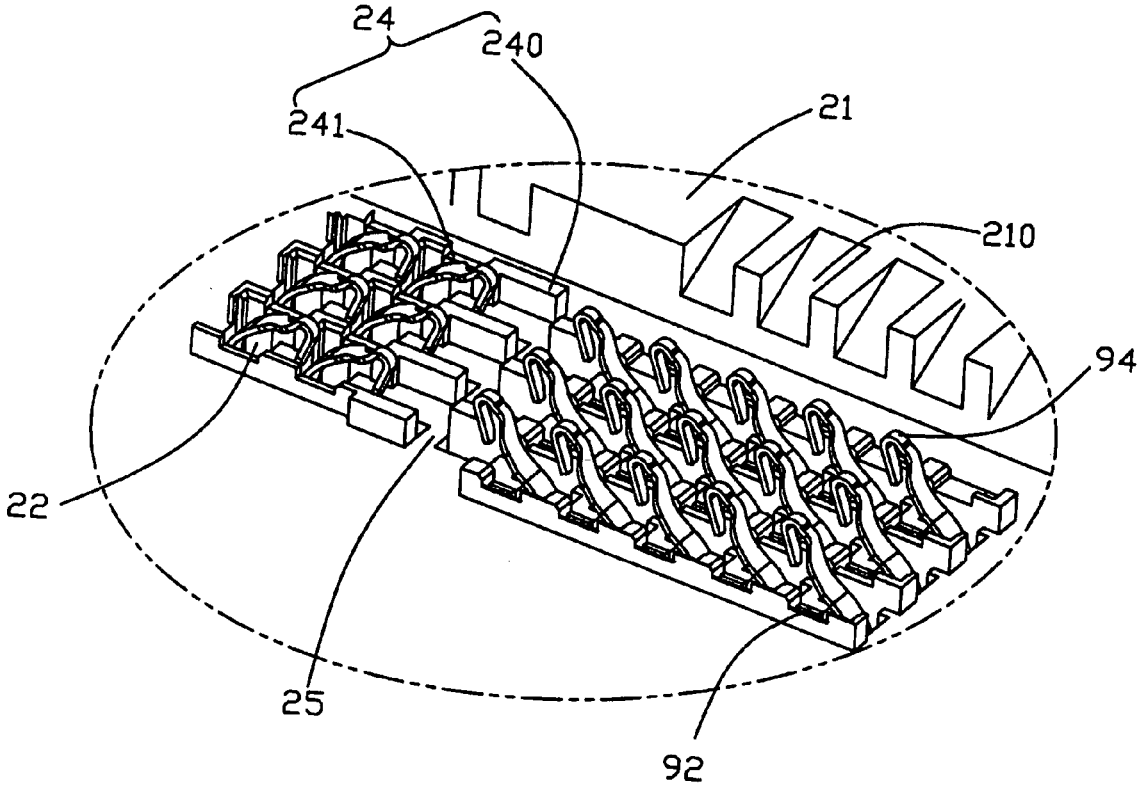
FIG. 7 is an enlarged view of the circled part VII in FIG. 6.
Figure 8:
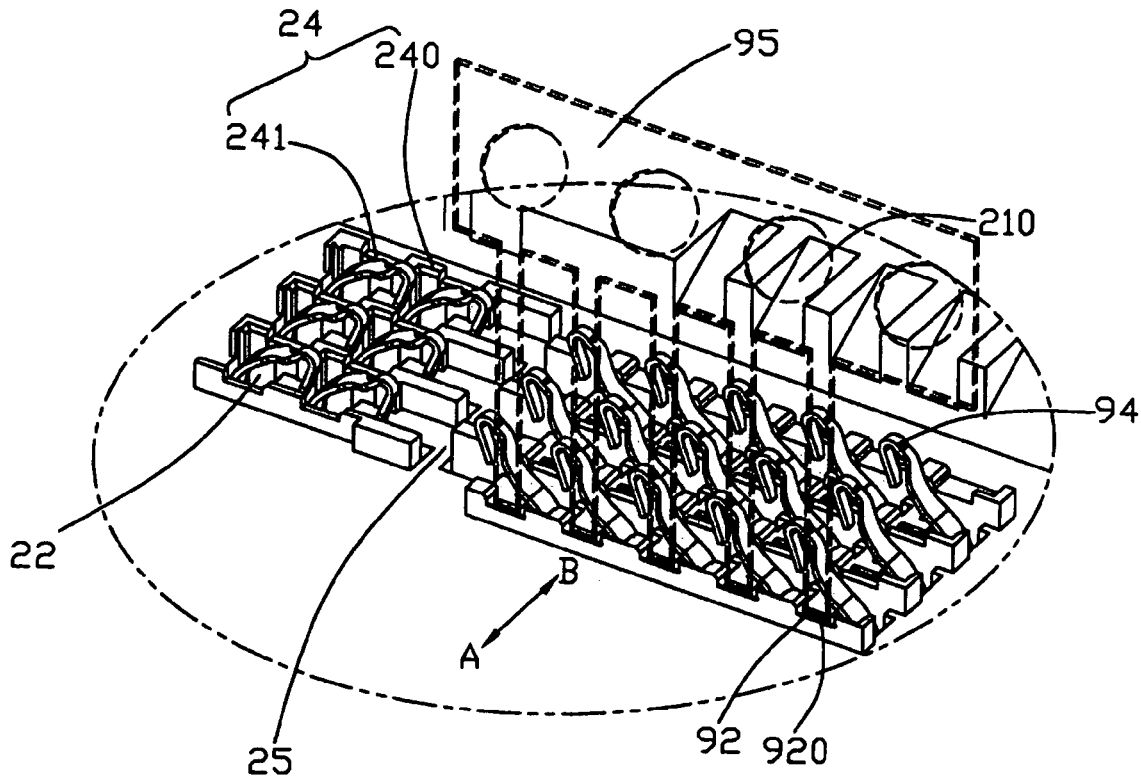
FIG. 8 is similar to FIG. 7, showing a virtual material strip linking the contacts.

Referring to FIGS. 7–8, contacts 9 are inserted into the cavities 22 with material strip 95 linking with the linking portions 92. After the contacts 9 are positioned in the housing 2, the linking portions 92 are positioned adjacent the sunken portions 241 of the first partition wall 24, and the strip 95 must be removed form the linking portions 92. Accordingly, the strip 95 must be cut away form the top ends 920 of the linking portions 92. And then, the strip 95 is removed along a direction AB shown in FIG. 8 via the sunken portions 241 and finally is removed from the housing 2 via the channels 210.

By virtue of the sunken portions 241 of the first partition wall 24, the strip 95 does not interfere with the first partition wall 241, which improve operation efficiency.

Furthermore, although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An Integrated Circuit (IC) socket to be mounted on a circuit board, comprising:

an insulative housing, which has a plurality, of cavities arranged in a matrix at an IC package receiving recess surrounded by peripheral walls;

a plurality of electrical contacts, which are provided in the plurality of cavities; and a fixing mechanism for fixing an IC package in the IC package receiving recess; wherein the insulative housing comprises first partition walls, which are provided between rows of cavities, and second partition walls, which are provided between rows of cavities and are perpendicular to the first partition walls, the first partition walls having protruding portions and sunken portions alternatively formed along a longitudinal direction thereof;

wherein the fixing mechanism comprises a metallic reinforcing plate surrounding the housing, a metallic cover member pivotally assembled to one end of the reinforcing plate, and an actuating lever pivotally assembled to the other end of the reinforcing plate.

2. The IC socket as described in claim 1, wherein the first partition walls have greater height than that of the second partition walls.

3. The IC socket as described in claim 1, wherein the peripheral walls of the housing definee a plurality of channels aligned with the sunken portions.

4. An Integrated Circuit (IC) socket for carrying an IC package thereon, comprising:

an insulative housing, which has a plurality of cavities arranged in a matrix at an IC package receiving recess surrounded by peripheral walls;

a plurality of electrical contacts secured in the plurality of cavities, the contacts being formed from a material strip and defines a spring arm extending out of the housing; and a fixing mechanism for fixing an IC package in the IC package receiving recess formed by peripheral walls; wherein the insulative housing defines a plurality of partition walls partitioning the cavities into a plurality of rows, and the partition walls are provided with protruding portions and sunken portions, which are arranged alternatively, the protruding portions defines a seating plane for supporting the IC package; wherein two opposed peripheral walls of the housing define a plurality of channels corresponding to the sunken portions.

5. The IC socket as described in claim 4, wherein the fixing mechanism comprises a metallic reinforcing plate surrounding the housing, a metallic cover member pivotally assembled to one end of the reinforcing plate, and an actuating lever pivotally assembled to the other end of the reinforcing plate.

6. The IC socket as described in claim 4, wherein each of the contact comprises a linking portion connecting with the strip.

7. The IC socket as described in claim 4, wherein the spring arm extends form the linking portion.

8. The IC socket as described in claim 4, wherein the linking portion of the contact is located adjacent the sunken portion.

9. An IC socket assembly comprising:

an insulative housing, which has a plurality of passageways arranged in matrix at an IC package receiving cavity surrounded by peripheral walls;

a plurality of electrical contacts respectively secured in the plurality of passageways, the contacts being formed from a material strip and defines a spring arm upwardly extending into the receiving cavity; and a moveable fixing mechanism for holding an IC package in the IC package receiving cavity;

the insulative housing defines a plurality of first partition walls partitioning the passageways into a plurality of rows along a lengthwise direction of the housing, and a plurality of second partition walls partitioning the passageways into a plurality of columns along a transverse direction that is perpendicular to said lengthwise direction; and an electronic package downwardly loaded to the receiving cavity to be seated to press downwardly the spring arms; wherein the second partition wall is recessed below the first partition wall for allowing downward movement of the spring arm of the corresponding contact which extends across the second partitioning wall and is depressed downwardly by the electronic package.

10. The IC socket assembly as claimed in claim 9, wherein said first partition wall defines a sunken portion recessed from a top surface thereof for facilitating detachment of the contact from the material strip during assembling.

* * * * *